United States Patent [19]

Hardy

[11] Patent Number: 4,619,779

[45] Date of Patent: Oct. 28, 1986

[54] DETERGENT ADDITIVE PRODUCT

[75] Inventor: Frederick E. Hardy, Gosforth, England

[73] Assignee: The Procter & Gamble Company, Cincinnati, Ohio

[21] Appl. No.: 680,609

[22] Filed: Dec. 12, 1984

Related U.S. Application Data

[63] Continuation of Ser. No. 508,763, Jun. 28, 1983, abandoned.

[30] Foreign Application Priority Data

Jun. 30, 1982 [GB] United Kingdom ..... 8218867

[51] Int. Cl.[4] ..... C11D 17/00

[52] U.S. Cl. ..... 252/91; 252/95; 252/102; 252/174; 252/186.26

[58] Field of Search ..... 252/90, 91, 95, 102, 252/174, 186.26

[56] References Cited

U.S. PATENT DOCUMENTS 4,179,390 12/1979 Spadini et al. ..... 252/95
4,220,562 9/1980 Spadini et al. ..... 252/542
4,248,928 2/1981 Spadini et al. ..... 428/286

FOREIGN PATENT DOCUMENTS 0073541 3/1983 European Pat. Off. .
0075419 3/1983 European Pat. Off. .
864798 4/1961 United Kingdom .
1586769 3/1981 United Kingdom .

*Primary Examiner*—Paul Lieberman
*Assistant Examiner*—Hoa Van Le
*Attorney, Agent, or Firm*—Leonard Williamson; Ronald L. Hemingway; Richard C. Witte

[57] ABSTRACT

A detergent additive product comprising a $C_5$–$C_{18}$ aliphatic peroxy carboxylic acid bleach precursor in water releasable combination with a non particulate flexible substrate in a weight ratio of precursor to substrate of 30:1 to 1:10. The aliphatic portion of the precursor incorporates a linear chain including and extending from the carbonyl carbon of from 6 to 10 carbon atoms. The product can also include peracetic acid precursors and other compatible organic and inorganic detergent components.

18 Claims, No Drawings

DETERGENT ADDITIVE PRODUCT

This is a continuation of application Ser. No. 508,763, filed on June 28, 1983 now abandoned.

FIELD OF THE INVENTION

This invention relates to laundry additive products in the form of compositions in water releasable combination with non particulate flexible substrates and is especially concerned with such products in which the composition comprises a peroxyacid bleach precursor.

More particularly, the invention relates to such laundry additive products in which the peroxy acid bleach precursor comprises an acyl radical incorporating an alkyl group of narrowly defined chain length attached to a leaving group containing a radical conferring water-solubility.

BACKGROUND OF THE INVENTION

The use of peroxy acid bleach precursors in water releasable combination with a non particulate sheet substrate is known in the art, being disclosed in British Pat. Nos. 1,586,769 and 2040983.

Numerous classes of peroxybleach precursors have also been disclosed in which the leaving group contains a radical conferring water solubility. One such class is the acyl oxybenzene sulphonates which are disclosed in British Pat. Nos. 864,798 and 836,988.

However it has now been found that aliphatic peroxy acids having a range of bleach performance previously thought to be unobtainable under domestic laundry washing conditions can be produced in the wash solution by the reaction of certain types of peroxyacid precursors with alkaline hydrogen peroxide. This range of bleaching performance encompasses the bleaching of fugitive dyes in the wash solution, the removal of conventional bleach sensitive stains such as tea, wine and coffee on fabric and also the removal of accumulated soil stains resulting from incomplete previous washes, the so called 'dingy fabric clean up'. The chemical instability of precursors, in powdered detergent compositions, particularly where the precursors have appreciable water-solubility, is well known and is acknowledged in BP No. 864,798 and is sought to be overcome therein by employing a coarse particle size for the precursor material. However, where the precursor molecule is inherently of lower solubility e.g. by virtue of the size of the acyl group and/or the size and nature of the leaving group, the use of a coarse particle size has a markedly adverse effect on the rate of precursor solubility in the wash solution. On the other hand, the incorporation of the acyl oxybenzene sulphonate into a non-particulate substrate permits the use of the precursor in very finely divided form without an accompanying loss in stability and also assists in improving the rate of peroxyacid generation from the accordingly one object of the present invention is the formulation of a detergent additive product in a non particulate form incorporating a precursor of an aliphatic organic peroxy acid of defined carbon chain length. Another object of the invention is the formulation of a non particulate detergent additive product providing enhanced 'dingy fabric' clean up when used in a detergent liquor containing a source of alkaline hydrogen peroxide. precursor in a wash liquor.

SUMMARY OF THE INVENTION

The present invention therefore provides a detergent additive product comprising (a) a composition comprising a peroxyacid bleach precursor having the general formula

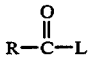

wherein R is an alkyl chain containing from about 5 to about 18 carbon atoms Wherein the longest linear alkyl chain extending from and including the carbonyl carbon contains from about 6 to about 10 carbon atoms, and L is a leaving group the conjugate acid of which has a pKa in the range from about 6 to about 13, said peroxy bleach precursor being in water-releasable combination with (b) a non particulate flexible substrate, the weight ratio of the precursor to the substrate being in the range from about 30:1 to 1:10.

Preferably, R is an alkyl chain containing from about 5 to about 12 carbon atoms and most preferably is a linear alkyl group of seven or eight carbon atoms.

In a preferred embodiment of the invention the composition also contains a peroxy acetic acid precursor in an amount sufficient to provide a molar ratio of peroxy acetic acid to $C_6$–$C_{10}$ aliphatic peroxy acid of from about 10:1 to about 1:1.

Preferably also the flexible substrate is in the form of a sheet wherein the weight ratio of the precursor to the sheet lies in the range from about 10:1 to about 1:10.

As used herein the term peroxyacid bleach precursor defines an organic compound capable of reaction with perhydroxyl ion derived from hydrogen peroxide or an inorganic peroxygen-containing compound in aqueous solution to give an organic peroxy acid having a bleaching performance at least equivalent to that of the hydrogen peroxide or inorganic peroxygen containing compound at a temperature of about 70° C. and below, under the same conditions.

Also, as used herein, the terms inorganic peroxy bleach and inorganic persalt are intended to cover salts such as alkali metal perborates, percarbonates, persilicates and perpyrophosphates which produce hydrogen peroxide in aqueous solution rather than compounds such as persulphates and permanganates which produce other peroxy species.

For the purposes of this invention water-releasable combination is taken to mean a combination capable of being separated by water through solution, dispersion, leaching, softening or melting.

In its broadest form the invention comprises two components viz, a $C_5$–$C_{18}$ alkyl group-containing acyl bleach precursor in which the longest linear alkyl chain including the carbonyl carbon contains from about 6 to about 10 carbon atoms, and the non-particulate flexible substrate.

The acyl group-containing bleach precursor has the general formula

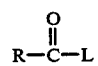

where R is a $C_5$–$C_{18}$ alkyl group in which the longest portion of the linear alkyl chain extending from and including the carbonyl carbon contains from about 6 to about 10 carbon atoms, and L is a leaving group the conjugate acid of which has a pKa in the range from about 6 to about 13.

Preferably, R is a $C_5$–$C_{12}$ alkyl group and more preferably is a $C_5$–$C_9$ linear alkyl group, the most preferred group being a $C_8$ linear alkyl moiety.

A leaving group is any group that is displaced from the bleach precursor as a consequence of the nucleophilic attack on the bleach precursor by perhydroxide anion generated by alkaline hydrogen peroxide. This, the perhydrolysis reaction, results in the formation of the percarboxylic acid. Generally, for a group to be a suitable leaving group it must exert an electron withdrawing effect within the precursor molecule as this facilitates the nucleophilic attack by the perhydroxide anion.

Suitable leaving groups for this purpose have conjugate acid forms, the pKa of which should lie within the range from about 6 to about 13. pKa values above 13 make the electron withdrawal effect so small as to be ineffective in promoting nucleophilic attack by perhydroxide anion, an example of such a leaving group being —$OCH_3$. pKa values below about 6 reflect such a large electron withdrawal effect as to make the molecule reactive to a wide variety of materials including e.g. water. Certain aliphatic anhydrides fall into this class.

Preferred leaving groups have a pKa in the range from about 7 to about 11, more preferably from about 8 to about 10. Examples of such leaving groups L are those having the formula (a)

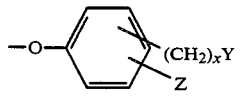

(b)

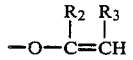

(c)

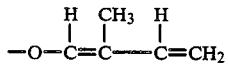

(d)

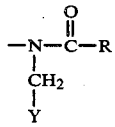

wherein $R_2$ is an alkyl group containing from 1 to 4 carbon atoms; $R_3$ is H or $R_2$; Z is H, $R_2$ or halide; Y is selected from —$SO_3M$
—$OSO_3M$
—$CO_2M$
—$N^+(R_2)_3Q^-$
—$N(R_2)_2 \rightarrow O$ wherein M is H, alkali metal or ammonium; and Q is halide or methosulphate; and x is 0 or an integer from 1 to 4.

The preferred leaving group L has the formula (a) in which Z is H, x is 0, and Y is a sulphonate, carboxylate or dimethyl amine oxide radical.

The position of the solubilising group Y on the benzene ring in formula (a) is not critical in that o -, m - and p-positions provide operable species. Nevertheless polar and steric factors make the p-substituted material easiest to synthesise and of most value in that its rate of perhydrolysis is fastest. In the preferred embodiment of leaving group L, where Y is a sulphonate radical, the precursor will normally be isolated in the form of its alkali metal salt because of the difficulty of handling the acid form.

Although the alkyl group R has been expressed as a single chain length material, commercial blends comprising 'cuts' of material having an average in the desired range can also be used. Such alkyl groups may be derived from naturally occurring materials or may be derived synthetically by e.g. OXO or Ziegler processes. The selection of the class of precursor for the present invention constitutes a compromise between thermal stability, chemical stability, water solubility and weight effectiveness. Raw material cost and ease of manufacture are also important considerations.

In the latter context, the increase in size of the preferred linear $C_5$–$C_9$ alkyl chain compared to a $CH_3$ group and the synthesis problems arising from this fact, makes it extremely difficult to produce structural analogues of commerically available precursors such as tetraacetyl ethylene diamine and tetraacetyl glycouril, and the resultant molecule tends to be too insoluble to be useful. The most preferred precursors viz. linear $C_6$–$C_{10}$ acyl oxybenzene carboxylates and acyl oxybenzene sulphonates, however, are reasonably water soluble although this property makes them more difficult to stabilise when incorporated into moisture-containing granular detergent products.

In the non-particulate additive products of the present invention, this aspect of chemical stability is less critical, as the invention, in its broadest form, does not require the presence of components other than the precursor in the composition combined with the substrate. Furthermore, in preferred compositions, incorporating hydroxyl group-containing processing aids and/or nonionic surfactants, the acylation reactivity of the $C_6$–$C_{10}$ acyl groups in the acyl oxybenzene sulphonate precursor is surprisingly low at normal temperatures.

Manufacture of the precursors uses techniques known in the art. A conventional synthesis route for acyl oxybenzene sulphonates employs the refluxing for six hours of trifluoroacetic anhydride, sodium phenol sulphonate and the aliphatic carboxylic acid corresponding to the desired peroxy acid. The product is recovered by cooling the reaction mixture, precipitating the peroxy acid precursor in a large excess of diethyl ether and filtering off the precipitate.

An alternative technique employs a two stage reaction in which the aliphatic carboxylic acid is first converted to the anhydride by means of an excess of acetic anhydride, followed by reaction of the recovered acyl anhydride with sodium phenol sulphonate.

The preferred method of synthesis involves heating n-nonanoyl chloride with sodium phenolsulphonate at 80°–100° C. in an aprotic solvent, e.g. dioxane, dichlorethane or toluene, in a current of nitrogen to remove by-pruduct HCl. The mixture is diluted with acetone or ether and the product is then filtered off.

As noted previously, bleach precursors of this class are known from BP No. 864,798, which discloses compounds in which the alkyl group can have from 1 to 9, preferably less than 7 carbon atoms and which accordingly release (in aqueous alkaline hydrogen peroxide solutions) the corresponding aliphatic monoperoxy acids. It has, however, been found that the bleaching characteristics of these peroxy acids are very dependent on their alkyl chain length and that some are of little practical value.

Peroxyacids having alkyl groups in the range $C_2$–$C_5$ provide approximately the same type of low temperature (<about 70° C.) bleaching capability, viz. removal of oxidisable stains such as tea and wine, as that for the $C_1$ alkyl peroxyacid (peroxyacetic acid). However, as they are less weight-effective, are more expensive to synthesise and the residual acids left after release of the active oxygen tend to be odorous, they are of little commercial interest.

The Applicants have also found that alkaline hydrogen peroxide solutions including acyl group-containing bleach precursors in which the alkyl group has about 10 or more carbon atoms provide little or no removal of tea or wine stains from fabrics at precursor usage levels in excess of 20 ppm. The lack of effect is even more marked in the presence of surfactants. Although the Applicants do not wish to be bound by any theory, it is believed that $C_{10+}$ acyl precursors themselves display a degree of surface activity which results in the molecules associating above a certain concentration (the critical micelle concentration or CMC) to form micelles. The precursors also tend to form mixed micelles with any other surfactant(s) which may be present.

In a micellar form the alkyl group of the precursor is believed to align itself in the inner, hydrophobic part of the micelle so that the $$-\underset{\underset{O}{\|}}{C}-O$$

linkage is not available for attack by the $^-OOH$ ion in the aqueous phase.

Consequently, only a limited quantity of monomeric species of the precursor is present in bulk solution whilst the remainder is concentrated in micelles which are themselves concentrated at either air-liquid or solid-liquid interfaces. This low monomer concentration combined with the low weight effectiveness of $C_{10+}$ linear aliphatic monoperoxy acids (i.e. wt of available oxygen/wt of peroxy acid) makes the $C_{10+}$ linear alkyl precursors of little practical value.

Even if $C_{10+}$ aliphatic monoperoxy acids are formed from their precursors, they do not provide appreciable stain removal of tea and wine stains although they do bleach oxidisable transient dyes associated with soil deposited and not removed in previous washes. This soil-dye interaction causes fabrics which have been subjected to many cycles of usage and washing to become dull and assume a grey tint. The accumulated soil tends to be a blend of particulate and greasy materials and the alkyl peroxy acids produced by the preferred $C_7$–$C_8$ linear acyl oxybenzene sulphonate bleach precursors are particularly effective in removing soil stains of this nature. The removal of this accumulated soil-dye staining is sometimes referred to as 'dingy fabric clean up'.

However, linear aliphatic peroxyacids in which the alkyl group has from about 5 to about 9 carbon atoms, more preferably from 6 to 9 carbon atoms and particularly 7 or 8 carbon atoms, display a range of bleaching capability and degree of bleaching performance which is surprising. It has been found that the $C_7$ and $C_8$ aliphatic peroxyacids not only give classic oxidisable soil-stain removal benefits on fabrics and inhibition of dye transfer via transient dyes in the bulk wash solution similar to those given by peroxyacetic acid, but also provide dingy fabric clean up.

The amount of the linear $C_6$–$C_{10}$ carbon chain-containing bleach precursor applied to the substrate is arranged such that the precursorsubstrate ratio is within the range from about 30:1 to about 1:10 more usually from about 10:1 to about 1:10 by weight. Conveniently, precursor:substrate weight ratios lie within the range from about 8:1 to about 1:2 and most preferably within the range from about 5:1 to about 1:1.

For the purposes of obtaining rapid solution and hence conversion of the linear $C_6$–$C_{10}$ carbon chain-containing bleach precursor, it is highly desirable that the precursor has the maximum surface area i.e. be in finely divided form. Where the precursor is precipitated out of solution on to the substrate the particle size will approach impalpability, i.e. individual particles cannot be distinguished from each other by touch which occurs at a particle size $\approx$50 microns and below. Where the precursor is incorporated on the substrate as a dispersion in a liquid medium, it is preferred that the particle size be reduced before incorporation to less than 180 microns, 200 microns maximum preferably less than 100 microns maximum.

In addition to the linear $C_6$–$C_{10}$ carbon chain-containing precursor, the products of the invention may optionally contain any of the organic peroxy acid bleach precursors known in the art. A detailed disclosure of such precursors is provided in British Patent Specification No. 2040983 which is thereby specifically incorporated herein by reference. For the purposes of the present invention, blends of linear $C_6$–$C_{10}$ acyl oxybenzene sulphonate or carboxylate with peracetic acid precursors are preferred, examples of such peracetic acid precursors including tetra acetyl ethylene diamine, tetra acetyl methylene diamine, tetra acetyl glycouril, sodium p-acetoxybenzene sulphonate, penta acetyl glucose, and octa acetyl lactose. However, the invention also contemplates blends of linear $C_6$–$C_{10}$ carbon chain-containing precursors with e.g. peroxybenzoic and peroxyphthalic acid precursors where different combinations of bleaching properties are required.

In blends of the preferred linear $C_6$–$C_{10}$ oxybenzene sulphonate precursors with other peroxyacid precursors it has been found that the $C_6$–$C_{10}$ acyl oxybenzene sulphonate should be present in an amount to provide a level of at least about 2 ppm and preferably at least about 5 ppm available oxygen in the wash liquor, in order that the benefit of the $C_6$–$C_{10}$ peroxy acid can be realised. Generally the weight ratio of the $C_6$–$C_{10}$ acyl oxybenzene sulphonate precursor to the other peroxy acid (e.g. peracetic acid) precursor should be such as to provide a $C_6$–$C_{10}$ alkyl peroxy acid:peracetic acid molar ratio in the range from about 1:1 to about 1:10. Under European washing conditions, blends in which the $C_6$–$C_{10}$ acyl oxybenzene sulphonate delivers from 5 to 15 ppm available oxygen in the wash liquor are preferred.

The level of usage of the precursor will naturally be dependent on a number of factors e.g. the size of the fabric load in the machine, the level of bleaching performance desired, the amount of perhydroxyl ion in the wash solution, the bleaching efficacy of the organic peroxy species derived from the precursor and the efficiency of conversion of the precursor into that peroxy species. It is conventional with inorganic peroxy bleaches to provide a level of available oxygen in solution from about 50 ppm to about 350 ppm by weight for heavy duty laundry purposes. However, when using organic peroxy bleaches a level of available oxygen provided by the organic peroxy compound may lie in the range from about 2 ppm to about 100 ppm, levels of from about 3 ppm to about 30 ppm being appropriate under conventional US washing conditions while levels of from about 20 ppm to about 50 ppm are more commonly used under European washing conditions. This level of available oxygen should be attained within the normal wash cycle time i.e. within 5–25 minutes depending on the particular wash cycle being employed.

For a machine having a liquid capacity in use of from about 20 to about 30 liters, such a level of available oxygen requires the delivery of from about 1 gr to about 20 gr of organic peroxy compound percursor assuming quantitative conversion. This figure will increase proportionately with any decrease in the efficiency of conversion. Preferably a single unit of substrate should be capable of accommodating this level of precursor and any adjuvants and additives that it is necessary to incorporate into the product although the number of units to be used to deliver a given quantity of precursor is a matter of choice. Normally the weight of precursor per delivery will lie in the range from about 3 to about 10 grs, preferably from about 4 to about 6 grs.

The second component of the invention, in its broadest form, is a non-particulate, flexible substrate with which the acyl oxybenzene sulphonate bleach precursor is in water releasable combination. The substrate may itself be water soluble or water insoluble and in the latter case it should possess sufficient structural integrity under the conditions of the wash to be recovered from the machine at the end of the laundry cycle. Structures which are water disintegratable i.e. that break down in aqueous media to insoluble individual fibres or particles are not considered satisfactory for the purposes of the present invention.

Water soluble materials include certain cellulose ethers, alginates, polyvinyl alcohol and water soluble polyvinyl pyrrolidone polymers, which can be formed into non-woven and woven fibrous structures. Suitable water insoluble materials include, but are not restricted to, natural and synthetic fibres, foams, sponges and films.

The substrate may have any one of a number of physical forms such as sheets, blocks, rings, balls, rods or tubes. Such forms should be amenable to unit usage by the consumer, i.e. they should be capable of addition to the washing liquor in measured amounts, such as individual sheets, blocks or balls and unit lengths of rods or tubes. Certain of these substrate types can also be adapted for single or multiple uses, and can be provided with loadings of organic peroxy acid precursor up to a precursor:substrate ratio of 30:1 by weight.

One such article comprises a sponge material releasably enclosing enough organic peroxy compound precursor to provide bleaching action during several washing cycles. This multi-use article can be made by impregnating a sponge ball or block with about 20 grams of the precursor and any adjuncts therewith. In use, the precursor leaches out through the pores of the sponge into the wash liquor and reacts with the inorganic peroxy bleach. Such a filled sponge can be used to treat several loads of fabrics in conventional washing machines, and has the advantage that it can remain in the washer after use.

Other devices and articles that can be adapted for use in dispensing the organic peroxy compound precursor in a washing liquor include those described in Dillarstone, U.S. Pat. No. 3,736,668, issued June 5, 1973: Compa et al, U.S. Pat. No. 3,701,202, issued Oct. 31, 1972: Furgal, U.S. Pat. No. 3,634,947, issued Jan. 18, 1972: Hoeflin, U.S. Pat. No. 3,633,538, issued Jan. 11, 1972 and Rumsey, U.S. Pat. No. 3,435,537, issued Apr. 1, 1969, all of which are hereby specifically incorporated herein by reference.

A highly preferred product comprises a $C_6$–$C_{10}$ linear acyl oxybenzene sulphonate precursor impregnated on a flexible sheet so as to make it compatible with the movement of the fabrics in the washing machine and to facilitate its handling during manufacture of the product. Preferably the sheet is water pervious i.e. water can pass from one surface of the sheet to the opposite surface and, for film type substrates, perforation of the sheet is desirable. The most preferred form of the substrate is a sheet of woven or non-woven fabric or a thin sheet of cellular plastics material. Woven fabric sheets can take the form of a plain weave natural or synthetic fibre of low fibre count/unit length, such as is used for surgical dressings, or of the type known as cheese cloth. Loading limitations on sheet type substrates limit the amount of precursor that can be applied to the sheet namely to a maximum represented by a precursor:sheet weight ratio of about 10:1.

A very desirable attribute of the laundry additive products of the present invention is that they do not interfere with the mechanical operation of the washing machine into which they are put. A high proportion of domestic washing machines are of the rotating perforated drum type in which the perforations extend over the entire peripheral surface. In this type of equipment the drum construction and mode of operation obviates any problem of obstruction to liquid flow in the machine. Certain older types of machine utilise an agitator in a stationary vessel provided with a recirculating liquid system. In order to avoid liquid blockage in this machine type it may be necessary to provide slits or perforations in the substrate, particularly if it is in sheet form. Sheet structures of this type are disclosed in McQueary U.S. Pat. Nos. 3,944,694 and 3,956,556 issued Mar. 16, 1976 and May 11, 1976 respectively, which are hereby incorporated herein by reference.

As stated above, suitable materials which can be used as a substrate in the invention herein include, among others, sponges, paper, and woven and non-woven fabrics.

A suitable sponge like material that can be used in the present invention comprises an absorbent foam like material in the form of a sheet. The term 'absorbent foam-like material' is intended to encompass three dimensional absorptive materials such as 'gas blown foams', natural sponges and composite fibrous based structures such as are disclosed in U.S. Pat. Nos. 3,311,115 and 3,430,630 both specifically incorported herein by reference. A particularly suitable material of this type is a hydrophilic polyurethane foam in which the internal cellular walls of the foam have been broken by reticulation. Foams of this type are described in detail in Dulle U.S. Pat. No. 3,794,029 specifically incorporated herein by reference. A preferred example of this foam type comprises a hydrophilic polyurethane foam of density 0.596 grs per cubic inch with a cell count of between about 8 and about 40 cells per cm, preferably about 24 to 32 per cm available from the Scott Paper Company, Eddystone, Pa. USA, under the Registered Trade Mark "Hydrofoam". Preferred sheets of this type of material have thicknesses in the range from about 3 to about 5 mm.

A suitable paper-based absorbent structure containing 2 or 3 paper plies is disclosed in U.S. Pat. No. 3,414,459.

The preferred substrates of the laundry additive products of the invention are apertured and non apertured nonwoven fabrics which can generally be defined as adhesively bonded fibrous or filamentous products, having a web or carded fibre structure (where the fibre strength is suitable to allow carding) or comprising fibrous mats, in which the fibres or filaments are distributed haphazardly or in random array (i.e. an array of fibres in a carded web wherein partial orientation of the fibres is frequently present as well as a completely haphazard distributional orientation) or substantially aligned. The fibres or filaments can be natural (e.g. wool, silk, wood pulp, jute, hemp, cotton, linen, sisal, or ramie), synthetic (e.g. rayon, cellulose, ester, polyvinyl derivatives, polyolefins, polyamides, or polyesters) or mixtures of any of the above.

Methods of making non-woven cloths are not a part of this invention and being well known in the art, are not described in detail herein. Generally, such cloths are made by air or water laying processes in which the fibres or filaments are first cut to desired lengths from long strands, passed into a water or air stream, and then deposited onto a screen through which the fibre-laden air or water is passed. The deposited fibres or filaments are then adhesively bonded together, dried, cured and otherwise treated as desired to form the non-woven cloth. Non-woven cloths made of polyesters, polyamides, vinyl resins, and other thermoplastic fibres can be bonded, i.e. the fibres are spun out onto a flat surface and bonded (melted) together by heat or by chemical reactions.

The absorbent properties desired herein are particularly easy to obtain with non-woven cloths and are provided merely by building up the thickness of the cloth, i.e. by superimposing a plurality of carded webs or mats to a thickness adequate to obtain the necessary absorbent properties, or by allowing a sufficient thickness of the fibres to deposit on the screen. Any diameter or denier of the fibre (generally up to about 10 denier) can be used, inasmuch as it is the free space between each fibre that makes the thickness of the cloth directly related to the absorbent capacity of the cloth, and which further makes the non-woven cloth especially suitable for impregnation with a peroxy compound precursor by means of intersectional or capillary action. Thus, any thickness necessary to obtain the required absorbent capacity can be used.

The choice of binder-resins used in the manufacture of non-woven cloths can provide substrates possessing a variety of desirable traits For example, the absorbent capacity of the cloth can be increased, decreased, or regulated by respectively using a hydrophilic binder-resin, a hydrophobic binder-resin or a mixture thereof in the fibre bonding step. Moreover, the hydrophobic binder-resin, when used singly or as the predominant compound of a hydrophobic-hydrophilic mixture, provides non-woven cloths which are especially useful as substrates when the precursor-substrate combinations disclosed herein are used in an automatic washer.

When the substrate herein is a non-woven cloth made from fibres, deposited haphazardly or in random array on the screen, the compositions exhibit excellent strength in all directions and are not prone to tear or separate when used in the washer.

Preferably, the non-woven cloth is water-laid or air-laid and is made from cellulosic fibres, particularly from regenerated cellulose or rayon, which are lubricated with standard textile lubricant. Preferably the fibres are from about 4 to about 50 mm in length and are from about 1.5 to about 5 denier (Denier is an internationally recognised unit in yarn measure, corresponding to the weight in grams of a 9,000 meter length of yarn). Preferably the fibres are at least partially orientated haphazardly, particularly substantially haphazardly, and are adhesively bonded together with hydrophobic or substantially hydrophobic binder-resin, particularly with a nonionic self-crosslinking acrylic polymer or polymers. Conveniently, the cloth comprises about 70% fibre and about 30% binder-resin polymer by weight and has a basis weight of from about 10 to about 100, preferably from about 24 to about 72 g/m$^2$.

A suitable example is an air-laid, non-woven cloth comprising 70% regenerated cellulose (American Viscose Corporation) and 30% hydrophobic binder-resins (Rhoplex HA-8 on one side of the cloth, Rhoplex HA-16 on the other; Rohm & Haas, Inc). The cloth has a thickness of 4 to 5 mils., and a basis weight of 29 g/m$^2$. A 30 cm length of the cloth 21 cm wide weighs 1.78 grams. The fibres are 10 mm in length, 1.5 denier, and are orientated substantially haphazardly. The fibres are lubricated with sodium oleate.

A further exemplary substrate is a water-laid, non-woven cloth commercially available from C H Dexter Co., Inc. The fibres are regenerated cellulose, 15 mm in length, 1.5 denier, and are lubricated with a similar standard textile lubricant. The fibres comprise 70% of the non-woven cloth by weight and are orientated substantially haphazardly; the binder-resin (HA-8) comprises 30% by weight of the cloth. The substrate is 4 mils thick, and it has a basis weight of 29 g/m$^2$. A 30 cm length of the cloth 21 cm wide, weighs 1.66 grams.

Apertured non-woven substrates are also useful for the purposes of the present invention. The apertures, which extend between opposite surfaces of the substrate are normally in a pattern and are formed during laydown of the fibres to produce the substrate. Exemplary apertured non-woven substrates are disclosed in U.S. Pat. Nos. 3,741,724, 3,930,086 and 3,750,237, all of which are hereby incorporated herein by reference. A suitable diamond patterned apertured substrate is obtainable from Chicopee Manufacturing Co., Milltown, N.J., USA under the Code No. SK 650 WFX 577 and comprising a polyester-wood pulp mixture having a basis weight of 50 g/m$^2$ and approximately 13 apertures per square cm.

Another preferred example of an apertured non-woven substrate, also available from Chicopee Manuacturing Co., under the Code No. AK 30 ML 1379 comprises a regenerated cellulose sheet of 3.0 denier fibres bonded with Rhoplex RA 8 binder (fibre:binder ratio 70:30) having a basis weight of 40 g/m$^2$ and 17 apertures/cm$^2$. A highly preferred square patterned apertured substrate of similar composition but fibre:binder ratio of 80:20 and basis weight 35 g/m$^2$ is also available from Chicopee BV Holland.

In general, apertured fabrics for the purposes of the invention have from about 10 to about 20 apertures/cm$^2$, preferably 12–18 apertures/cm$^2$.

The size and shape of the substrate sheet is a matter of choice and is determined principally by factors associated with the convenience of its use. Thus the sheet should not be so small as to become trapped in the crevices of the machine or the clothes being washed or so large as to be awkward to package and dispense from the container in which it is sold. For the purposes of the present invention sheets ranging in plan area from about 130 $cm^2$ to about 1300 $cm^2$ are acceptable, the preferred area lying in the range of from about 520 $cm^2$ to about 780 $cm^2$.

In addition to the $C_6$–$C_{10}$ linear carbon chain-containing bleach precursor, one or more other materials can be applied to the substrate either separately or together with the precursor.

The type and level of such optional materials is constrained only by the requirements of unreactivity towards the precursor (if the optional materials are applied so as to be in intimate contact with the precursor) and by the loading limitations of the substrate. As described in more detail hereinafter, materials that are capable of reaction with the precursor can be incorporated in additive products of the present invention but it is essential that the precursor is spatially separate therefrom, i.e. is disposed at a substrate location that is free or substantially free of the other reactant materials. Individual optional components can be incorporated in amounts up to those corresponding to component:substrate weight ratios of about 20:1. However, for processing and product aesthetics reasons, the total weight of optional components per sheet is normally held to a maximum of about 12 times the sheet weight, and ideally is less than about 7 times the sheet weight, individual components being present at no more than about 4 times the sheet weight.

One factor determining the acceptable level of incorporation of an optional ingredient is its physical characteristics i.e. whether it is liquid or solid and if solid whether it is crystalline or waxy and of high or low melting or softening point.

Highly desirable optional components are solid, water soluble or water dispersible organic processing aids of a waxy nature having a Mpt in the range from about 30° C. to about 80° C. The most preferred processing aids have a softening point greater than 40° C. and a melting point less than 80° C. to permit their easy processing.

The preferred $C_7$–$C_{10}$ acyl group-containing precursors such as the oxybenzene sulphonates and carboxylates are solids having melting points in excess of 150° C., that for the sulphonate being >200° C. whilst the carboxylate melts at 165° C. It is therefore preferred to incorporate one or more organic adjuvants as described above to serve as an aid in processing and/or in releasing the precursor from the substrate when the latter is introduced into a wash liquor. The preferred adjuvants serve as plasticisers or thickeners in the incorporation of the precursors into or onto the substrate and ideally are non-hygroscopic solids that are mixed with the precursors and melted to provide mixtures having a viscosity of up to 5000 centipoises at 50° C.

Typical solids are $C_{14}$–$C_{18}$ primary and secondary alcohols and $C_{12}$–$C_{20}$ fatty acids and ethoxylates thereof containing from 15 to 80 ethylene oxide groups per mole of alcohol, sorbitan esters of $C_{12}$–$C_{20}$ fatty acids and polyethylene glycols of Mwt 4000–10,000. As stated hereinbefore, preferred materials are those of low hygroscopicity particularly the $C_{14}$–$C_{18}$ saturated fatty acids.

In particularly preferred embodiments of the invention incorporating a mixture of surfactants, the surfactant mixture itself can serve as a processing aid thereby reducing or eliminating the need for an additional processing aid.

Insoluble waxy materials such as paraffin waxes can also be used in minor amounts. Where the processing aid does not have any other function in the product such as a component of the surfactant mixture, its level of incorporation will be such that the precursor:processing aid weight ratio will be in the range from about 20:1 to about 1:3, the latter value being for economic reasons. However, the weight ratio of precursor:processing aid can be as low as about 1:10 where the processing aid has other functional properties such as surfactancy.

As indicated above, the organic adjuvant can serve as a release aid that assists in releasing the precursors from the substrate upon addition of the product to a wash liquor. In general, materials serving as processing aids are also suitable as release aids but certain materials, notably $C_{16}$–$C_{18}$ fatty acids and polyethylene glycols of MWt 4,000–8,000, are particularly effective when used in amounts such that the weight ratio of precursors:-release aid lies in the range from about 20:1 to about 1:2 particularly from about 4:1 to about 1:1.

A further type of release aid is one that is applied to the substrate either during manufacture or prior to the loading of the substrate by the precursor and any other components. Adjuvants of this type are conventionally fluorocarbons or silicone polymers adapted to modify the surface characteristics of the substrate so as to facilitate the removal of the active components on contact with water. Fluorocarbon treating solutions identified as FC807 and 808 and available from the 3M Company, Minneapolis, Minn., provide improved release when applied in amounts such that the weight ratio of substrate-fluorocarbon solids lies in the range from about 500:1 to about 50:1, preferably about 300:1.

In addition to the foregoing optional components that are of primary value in incorporating the precursor onto, and releasing it from, the substrate, conventional detergent ingredients can be incorporated into the composition provided that they do not contain water of crystallisation and are not reactive towards the precursor under anhydrous or substantially anhydrous conditions. Thus, surfactants, suds modifiers, chelating agents, anti-redeposition and soil suspending agents, optical brighteners, bactericides, anti-tarnish agents, enzymatic materials, fabric softeners, antistatic agents, perfumes and bleach catalysts can all be introduced into a wash liquor by means of the additive products of the present invention, subject to the contraints imposed by the loading limitations of the substrate.

The surfactant can be any one or more surface active agents selected from the group consisting of anionic, nonionic, zwitterionic, amphoteric and cationic classes and mixtures thereof. Anionic surface active agents can be natural or synthetic in origin; nonionic surface active agents can be either semi-polar or alkylene oxide types and cationic surfactants can include amine salts, quaternary nitrogen and phosphorus compounds and ternary sulphonium compounds. Specific examples of each of these classes of compounds are disclosed in Laughlin & Heuring U.S. Pat. No. 3,929,678 issued Dec. 30, 1975, specifically incorporated herein by reference.

However, certain nonionic and cationic surfactants, (of formula defined hereinafter) although useful when incorporated individually in additive products of the present invention, have in combination, been found to provide enhanced removal of greasy oily stains, particularly when used in conjunction with conventional anionic surfactant-containing detergent products. In such nonionic surfactant cationic combinations the cationic surfactant is water dispersible in admixture with the nonionic surfactant and the weight ratio of the nonionic surfactant to the cationic surfactant is in the range from about 20:1 to about 1:2. Preferably the ratio of the nonionic to cationic surfactants lies within the range from about 10:1 to about 1:1 by weight and most preferably within the range from about 5:1 to about 3:2.

The nonionic surfactants used in the compositions may be alkoxylated aliphatic alcohols, alkyl phenols, esters, amides and fatty acids having an HLB within the range 8.0–17.0. The aliphatic alcohols include linear and branched chain primary and secondary $C_8$–$C_{22}$ alcohols, the alkyl phenols are the $C_6$–$C_{12}$ alkyl phenols, and the fatty esters, fatty amides and fatty acids are those having a $C_{12}$–$C_{18}$ alkyl group in the acyl residue. The preferred alkoxylating group is ethylene oxide.

Suitable nonionic surfactants based on aliphatic alcohols are condensation products of primary and secondary alcohols with from about 4 to about 30 moles of ethylene oxide. The alkyl chain of the aliphatic alcohol can either be straight or branched and generally contains from about 8 to about 22 carbon atoms. Examples of such ethoxylated alcohols include the condensation product of myristyl alcohol with 10 moles of ethylene oxide per mole of alcohol and the condensation product of 9 moles of ethylene oxide with coconut alcohol (a mixture of fatty alcohols with alkyl chains varying in length from 10 to 14 carbon atoms). Examples of commercially available nonionic surfactants of this type include Tergitol 15-S-9, marketed by Union Carbide Corporation, Neodol 45E9, marketed by Shell Chemical Company, and Kyro EOB, marketed by The Procter & Gamble Company. Other suitable alcohol ethoxylates include:

| | | |
|---|---|---|
| Tallow | ($C_{16}$—$C_{18}$) | alcohol ($E_{25}$) |
| Linear | ($C_{14}$—$C_{15}$) | alcohol ($E_5$) |
| | ($C_{14}$—$C_{15}$) | alcohol ($E_7$) |
| | ($C_{12}$—$C_{13}$) | alcohol ($E_6$) |
| | ($C_9$—$C_{11}$) | alcohol ($E_5$) |
| Branched | ($C_{10}$—$C_{13}$) | alcohol ($E_4$) |
| Linear | (s-$C_{11}$—$C_{15}$) | alcohol ($E_5$) |
| | (s-$C_{11}$—$C_{15}$) | alcohol ($E_7$) |
| | (s-$C_{11}$—$C_{15}$) | alcohol ($E_9$) |

Alcohol ethoxylates such as those disclosed in British Patent Specification No. 1,462,134 specifically incorporated herein by reference are also useful.

Suitable alkyl phenol ethoxylates include the condensation products of alkyl phenols having an alkyl group containing from about 6 to about 12 carbon atoms in either a straight chain or branched chain configuration with ethylene oxide, said ethylene oxide being present in an amount equal. to 8 to 20 moles of ethylene oxide per mole of alkyl phenol. The alkyl substituent in such compounds can be derived, for example, from polymerized propylene, di-isobutylene, and the like. Examples of compounds of this type include nonyl phenol condensed with 9.5 moles of ethylene oxide per mole of nonyl phenol; dodecylphenol condensed with 12 moles of ethylene oxide per mole of phenol; and di-isooctyl phenol condensed with 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

Other suitable phenol ethoxylates include:

| | |
|---|---|
| Linear | $C_8$ Alkyl phenol ($E_5$) |
| | $C_8$ Alkyl phenol ($E_8$) |
| | $C_9$ Alkyl phenol ($E_6$) |
| | $C_9$ Alkyl phenol ($E_9$) |

Suitable fatty acid ethoxylates include coconut fatty acid ($E_5$) and oleic fatty acid ($E_{10}$), while ester ethoxylates include:

| | |
|---|---|
| Sorbitan monooleate | ($E_5$) |
| Sorbitan trioleate | ($E_{20}$) |
| Sorbitan monostearate | ($E_4$) |
| Sorbitan tristearate | ($E_{20}$) |

Other nonionic surfactants useful herein include the condensation products of ethylene oxide with the product resulting from the reaction of propylene oxide and ethylene diamine, and the condensation product of ethylene oxide wtih the product resulting from the condensation of propylene oxide with propylene glycol. Surfactants of this type are available commercially from the Wyandotte Chemicals Corporation under the neames "Tetronic" and "Pluronic" respectively.

Particularly preferred materials are the primary linear and branched chain primary alcohol ethoxylates, such as $C_{14}$–$C_{15}$ linear alcohols condensed with from about 7 to about 15 moles of ethylene oxide available from Shell Oil Co. under the "Dobanol" Trade Mark and the $C_{10}$–$C_{13}$ branched chain alcohol ethoxylates obtainable from Liquichimica SA under the "Lial" Trade Mark.

The cationic surfactants used in the compositions of the present invention have the empirical formula $$R_m^1R^2_xY_LZ$$

wherein each $R^1$ is a hydrophobic organic group containing alkyl chains, alkenyl chains, alkyl benzyl chains, alkyl phenyl chains, ether linkages, alkylene groups, alkenylene groups, ester linkages, and amide linkages totalling from 8 to 22 carbon atoms and which may additionally contain or be attached to a polyethylene oxide chain containing up to 20 ethoxy groups, and m is a number from one to three. No more than one $R^1$ in a molecule can have more than 16 cabon atoms when m is 2 and no more than 12 carbon atoms when m is 3. $R^2$ is an alkyl or hydroxyalkyl group containing from 1 to 4 carbon atoms or a benzyl group with no more than one $R^2$ in a molecule being benzyl, and x is a number from 0 to 3. The remainder of any carbon atom positions on the Y group are filled by hydrogens. Y is selected from the group consisting of:

$$-\overset{|}{\underset{|}{N}}{}^{+}- \qquad (1)$$

-continued (2)

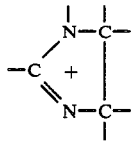

(3)

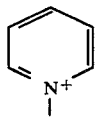

L is a number from 1 to 4, and Z is a water-soluble anion, such as a halide, methylsulphate, hydroxide, or nitrate anion, particularly preferred being chloride, bromide or iodide anions, in a number to give electrical neturality of the cationic component. The particular cationic component to be included in a given system depends to a large extent upon the particular nonionic component to be used in this system, and is selected such that it is at least water-dispersible, or preferably water-soluble, when mixed with said nonionic surfactant. It is preferred that the cationic component be substantially free of hydrazinium groups. Mixtures of these cationic materials may also be used in the compositions of the present invention.

When used in combination with nonionic surfactants, these cationic components provide excellent soil removal characteristics, confer static control and fabric softening benefits to the laundered fabrics, and inhibit the transfer of dyes among the laundered fabrics in the wash solution.

In preferred cationic materials, L is equal to 1 and Y is

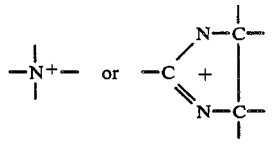

However, L may be greater than 1, such as in cationic components containing 2 or 3 cationic charge centres. Where Y is

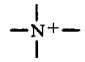

and m=1 it is preferred that x is equal to 3. $R_2$ is normally a methyl group but a preferred structure is where one $R_2$ group is hydroxy ethyl. Cationic surfactants of this mono long chain type include those in which $R^1$ is a $C_{10}$–$C_{20}$ alkyl group more preferably a $C_{10}$–$C_{16}$ alkyl group. Particularly preferred compositions of this class include $C_{12}$ alkyl trimethyl ammonium bromide, $C_{12}$ alkyl dimethyl hydroxy ethyl ammonium bromide and $C_{12}$ alkyl dimethyl hydroxypropyl ammonium bromide and their counterparts based on middle-cut coconut alcohol as the source of the alkyl group. Other counter ions such as methosulphate, sulphate, sulphonate and carboxylate can also be used particularly with the hydroxyalkyl-substituted compounds.

Where m is equal to 2, only one of the $R^1$ chains can be longer than 16 carbon atoms. Thus, ditallowdimethylammonium salts used conventionally as fabric softeners and static control agents in detergent compositions, may not be used as the cationic component in the surfactant mixtures of the present invention. Preferred di-long chain cationics of this type include those in which x is equal to 2 and $R^2$ is a methyl group. In this instance it is also preferred that $R^1$ is a $C_8$ to $C_{12}$ alkyl group. Particularly preferred cationic materials of this class include di-$C_{10}$ alkyldimethylammonium halide and di-$C_{12}$ alkyldimethylammonium halide materials.

Where m is equal to 3, only one of the $R^1$ chains can be greater than 12 carbon atoms in length. The reason for this chain length restriction, as is also the case with the di-long chain cationics described above, is the relative insolubility of these tri- and di-long chain materials. Where tri-long chain alkyl materials are used, it is preferred that x is equal to 1 and that $R^2$ is a methyl group. In these compositions it is preferred that $R^1$ is a $C_8$ to $C_{11}$ alkyl group. Particularly preferred tri-long chain cationics include trioctylmethylammonium halide, and tridecylmethylammonium halide.

Cationic components in which m is equal to 1 and the hydrophobic group $R_1$ is interrupted by ester linkages are disclosed in U.S. Pat. No. 4,260,529 specifically incorported herein by reference. Particularly preferred cationic surfactants of this type are the choline ester derivatives having the following formula

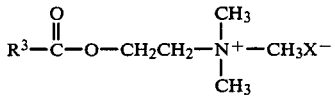

as well as those wherein the ester linkage in the above formula is replaced with a reverse ester, amide or reverse amide linkage.

Particularly preferred examples of this type of cationic surfactant include stearoyl choline ester quaternay ammonium halide ($R^3=C_{17}$ alkyl), palmitoyl choline ester quaternary ammonium halides ($R^3=C_{16}$ alkyl), myristoyl choline ester quaternary ammonium halides ($R^3=C_{13}$ alkyl), lauroyl choline ester ammonium halides ($R^3=C_{11}$ alkyl), and tallowoyl choline ester quaternary ammonium halides ($R^3=C_{16}$–$C_{18}$ alkyl).

These preferred cationic components are useful in nonionic/cationic surfactant mixtures which have a ratio of nonionic to cationic of from 10:6 to 20:1. However, when used in the additive products of the present invention, they are used in surfactant mixtures which have nonionic to cationic ratios of from 10:2 to 10:6, particularly from 10:3 to 10:5, most preferably 10:4. These preferred cationic surfactants may also be used in the detergent systems defined in U.S. Pat. No. 4,259,217, in nonionic to cationic ratios of from 8:1 to 20:1.

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length together with 2-haloethanol, in the presence of an acid catalyst material. The reaction product is then used to quaternize triethanolamine, forming the desired cationic component.

These surfactants, when used in the compositions of the present invention, yield excellent particulate soil, body soil, and grease and oil soil removal and compositions containing these surfactants also control static and soften the fabrics laundered therewith, and inhibit the transfer of dyes in the washing solution.

In compositions incorporating mixtures of nonionic and cationic surfactants it is preferred that the amount of the nonionic-cationic mixture is such that the surfactant mixture:substrate weight ratio lies in the range from about 20:1 to about 1:5, preferably from about 10:1 to about 1:2, and most preferably from about 5:1 to about 1:1. In preferred executions using non-woven sheet substrates of approximately 645 $cm^2$ plan area and about 3 grs/sheet basis weight, the loading of nonionic-cationic surfactant mixture is normally in the range 5–15 grs/sheet.

Other optional ingredients include suds modifiers which can be of the suds boosting, suds stabilising or suds suppressing type. Examples of the first type include the $C_{12}$–$C_{18}$ fatty acid amides and alkanolamides, the second type is exemplified by the $C_{12}$–$C_{16}$ alkyl dilower alkyl amine oxides and the third type by $C_{20}$–$C_{24}$ fatty acids, certain ethylene oxide-propylene oxide copolymers such as the "Pluronic" series, silicones, silica-silicone blends, micro-crystalline waxes, triazines and mixtures of any of the foregoing.

Preferred suds suppressing additives are described in U.S. Pat. No. 3,933,672, issued Jan. 20, 1976 and specifically incorporated herein by reference, relative to a silicone suds controlling agent. The silicone material can be represented by alkylated polysiloxane materials such as silica aerogels and xerogels and hydrophobic silicas of various types. The silicone material can be described as siloxane having the formula:

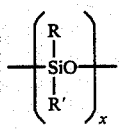

wherein x is from about 20 to about 2,000, and R and R′ are each alkyl or aryl groups, especially methyl, ethyl, propyl, butyl and phenyl. The polydimethylsiloxane (R and R′ are methyl) having a molecular weight within the range of from about 200 to about 200,000, and higher, are all useful as suds controlling agents. Additional suitable silicone materials which exhibit useful suds controlling properties, are those wherein the side chain groups R and R′ are alkyl, aryl, or mixed alkyl and aryl hydrocarbyl groups, examples including diethyl-, dipropyl-, dibutyl-, methyl-, ethyl-, and phenylmethyl- polysiloxanes. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trixethylsilanated) silica having a particle size in the range from about 10 millimicrons to about 20 millimicrons and a specific surface area above about 50 $m^2$/gm intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. Pat. No. 4,136,045 specifically incorporated herein by reference. An example of such a compound is DB-544, commercially available from Dow Corning, which is a siloxane/glycol copolymer.

Suds modifiers as described above are incorporated at levels of up to approximately 5%, preferably from 0.1 to 2% by weight of the cationic-nonionic surfactant mixture.

Chelating agents that can be incorporated include citric acid, nitrilotriacetic and ethylene diamine tetra acetic acids and their salts, organic phosphonate derivatives such as those disclosed in Diehl U.S. Pat. No. 3,213,030 issued 19 Oct., 1965; Roy U.S. Pat. No. 3,433,021 issued 14 Jan., 1968; Gedge U.S. Pat. No. 3,292,121 issued 9 Jan., 1968; and Bersworth U.S. Pat. No. 2,599,807 issued 10 June, 1952, and carboxylic acid builder salts such as those disclosed in Diehl U.S. Pat. No. 3,308,067 issued 7 Mar., 1967, all of the above patents being specifically incorported herein by reference. Preferred chelating agents include nitrilotriacetic acid (NTA), nitrilotrimethylene phosphonic acid (NTMP), ethylene diamine tetra methylene phosphonic acid (EDTMP) and diethylene triamine penta methylene phosphonic acid (DETPMP), and these are incorporated in amounts such that the substrate chelating agent weight ratio lies in the range from about 20:1 to about 1:5, preferably from about 5:1 to about 1:5 and most preferably from about 3:1 to about 1:1. Certain polybasic acids have been found to enhance the bleaching effect of organic peroxyacids produced when the products of the present invention are used with conventional detergent compositions, examples being EDTMP, NTMP and DETPMP. However, not all chelating polybasic acids are useful in this respect, while certain poorly-chelating polybasic acids, notably succinic acid, and glutaric acid, do show efficacy.

A wide range of fabric softeners and antistatic agents can be included as optional compounds. Exemplary cationic nitrogen compounds include the di-$C_{16}$–$C_{18}$ alkyl, di-$C_1$–$C_4$ alkyl quaternary ammonium salts, imidazolinium salts and non-nitrogenous materials such as the sorbitan esters of $C_{16}$–$C_{18}$ fatty acids. A preferred fabric softening and antistatic composition suitable for incorporation into additive products of the present invention is disclosed in U.S. Pat. No. 3,936,537 issued 3 Feb., 1976 to R. Baskerville & F. G. Schiro.

Preferred enzymatic materials include the commercially available amylases, and neutral and alkaline proteases conventionally incorporated into detergent compositions. Suitable enzymes are discussed in U.S. Pat. Nos. 3,519,570 and 3,533,139 both patents being specifically incorporated herein by reference. Examples of suitable enzymes include the materials sold under the Registered Trade Marks Maxatase, Rapidase and Alcalase.

Optical brighteners may be anionic or nonionic in type and are added at levels of from about 0.05 to about 1.0 grs per sheet preferably from 0.1 to 0.5 grs per sheet.

Anionic fluorescent brightening agents are well-known materials, examples of which are disodium 4,4'-bis-(2-diethanolamino-4-anilino-s-triazin-6-ylamino) stilbene-2:2'disulphonate, disodium 4,4'-bis-(2-morpholino-4-anilino-s-triazin-6-ylaminostilbene-2:2'-disulphonate, disodium 4,4'-bis-(2,4-dianilino-s-triazin-6-ylamino) stilbene-2:2'-di-sulphonate, disodium 4,4'-bis-(2-anilino-4-(N-methyl-N-2-hydroxyethylamino)-s-triazin-6-ylamino) stilbene-2,2'-di-sulphonate, disodium 4,4'-bis-(4-phenyl-2,1,3-triazol-2-yl)-stilbene-2,2'-disulphonate, disodium 4,4'-bis(2'-anilino-4-(1-methyl-2-hydroxyethylamino)-s-triazin-6-ylamino)stilbene-2,2'disulphonate, sodium 2(stilbyl-4''-(naptho-1',2':4,5)-1,2,3-triazole-2''-sulph onate and di-sodium 4,4'-bis(2-sulphonato styryl)biphenyl.

Other fluorescers to which the invention can be applied include the 1,3-diaryl pyrazolines and 7-alkylaminocoumarins.

A preferred fluroescer is the anionic material available from Ciba Geigy S.A. under the trade name Tinopal CBS and mixtures thereof with materials available under the trade names Tinopal EMS and Blankophor MBBN, the latter being sold by Farbenfabriken Bayer AG.

Other preferred optional ingredients include the multifunctional photoactivator/dyes belonging to the porphine class of general formula

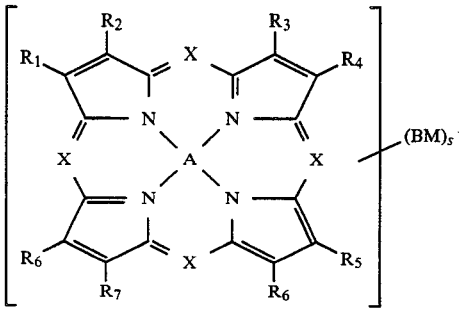

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with orthoarylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; wherein, when B is cationic, M is an anion and s is from 1 to 8; when B is nonionic, B is polyethoxylate, M is zero, s is from 1 to 8, and the number of condensed ethylene oxide molecules per porphine molecule is from 8 to 50; when B is anionic and proximate, M is cationic and s is from 3 to 8; when B is anionic and remote, M is cationic and s is from 2 to 8; and when B is sulphonate the number of sulphonate groups is no greater than the number of aromatic and heterocyclic substituent groups.

As used herein, a solubilizing group attached to a carbon atom displaced more than 5 carbon atoms away from the porphine core is referred to as "remote"; otherwise it is "proximate".

Highly preferred materials of this general type are the zinc phthalocyanine tri- and tetrasulphonates and mixtures thereof. Materials of this general class were originally disclosed for use in detergent compositions in British Pat. Nos. 1,372,035 and 1,408,144 and are discussed in detail in European Patent Application No. 3861 said patents and patent application being specifically incorporated herein by reference. The photoactivators can provide bleaching effects on fabrics washed with the detergent additive compositions and dried in the presence of visible light and atmospheric oxygen and can also synergistically enhance the bleaching effect of conventional bleaching agents such as sodium perborate. The porphine bleach is preferably used in an amount such that the level of porphine in the composition is in the range from about 0.004% to about 0.5%, more preferably from about 0.001% to about 0.1%, especially from 0.002% to 0.05% by weight.

Anti redeposition and soil suspension agents also constitute preferred components of the additve compositions of the invention. Cellulose derivatives such as methyl cellulose, carboxymethyl cellulose and hydroxy ethyl cellulose are examples of soil suspension agents and suitable antiredeposition agents are provided by homo- or co-polymeric polycarboxylic acids or their salts in which at least two carboxyl radicals are present separated by not more than two carbon atoms.

Highly preferred polymeric polycarboxylic acids are copolymers of maleic acid or maleic anhydride with methyl vinyl ether, ethyl vinyl ether or acrylic acid, the polymers having a molecular weight in the range from about 12,000 to about 1,500,000.

A further description of suitable polymeric polycarboxylic acids is provided in the Applicants' European Published Patent Application No. 0063017 specifically incorporated herein by reference. Preferably the weight ratio of the total amount of bleach precursor present to the polymeric carboxylic acid lies in the range from about 10:1 to about 1:3, preferably from about 5:1 to about 1:2.

The additive products herein comprise a precursor in water-releasable combination with a solid non-particulate substrate. Preferably the substrate is absorbent and the precursor is impregnated therein. Application of the precursor can be carried out in any convenient manner, and many methods are known in the art. As the preferred acyloxybenzene sulphonate or carboxylate precursors are solid at temperatures in excess of 150° C., one form of application is by solution in organic solvents which are volatilised after application, whilst another employs a slurry or suspension of the finely divided solid in water or other liquid media.

Preferred compositions in accordance with the invention are substantially anhydrous and thus incorporation on the substrate is best accomplished by utilisation of a non aqueous liquid medium.

A highly preferred embodiment of the invention utilises a processing aid and/or other optional ingredients in molten form as the liquid medium in which the finely divided precursor is dispersed.

Where the substrate comprises a non-sheet like reticulated foam article, direct impregnation of the article by a liquid medium incorporating the dispersed precursor, either alone or with other components of the formulation can be used, employing methods known in the art and described in more detail hereinafter. Where the substrate comprises a non-woven material or a foam article of sheet-like form, it is preferred to mix the bleach precursor with a compatible non-hygroscopic material of higher melting point, such as the processing aids hereinbefore described to provide a waxy solid in which the surfactant is present in the form of a solid solution and/or as a dispersed phase. The melting point range and waxy nature of polyethylene glycols of molecular weight>about 4000 make them useful for this purpose.

Where nonionic surfactants form components of the composition, their physical properties may permit their use as, or as part of, a liquid medium in which the precursor and other solid components are incorporated.

Where the nonionic surfactant is a solid at normal temperature but is molten at a temperature less than 100° C., preferably less than 80° C., the surfactant can be used as the sole vehicle for incorporating other non liquid components into the substrate. Alcohols having high levels of ethoxylation such as Tallow alcohol ($E_{25+}$) and $C_{14}$–$C_{15}$ primary alcohol $E_{15}$ are examples of such materials.

As previously indicated, materials reactive towards the $C_6$–$C_{10}$ linear carbon chain-containing bleach precursor can be incorporated in the additive products of the present invention provided that the precursor and the reactive material are spatially separated from one another. Inorganic peroxygen bleaches which either contain water or hydrogen peroxide in hydrogen bonded form, such as sodium perborate tetrahydrate, sodium percarbonate, sodium persilicate or sodium perpyrophosphate, and also urea-hydrogen peroxide addition products, are materials which are sufficiently reactive to require this spatial separation.

Where the precursor and the inorganic peroxygen bleach are incorporated in physically separate locations on the same substrate, a convenient method of application is the deposition of the respective melts, suspensions or solutions as discrete bands of material on the substrate. Preferably the bleach is applied as a dispersion of solid particles in a molten processing aid (as hereinbefore described) at a temperature in the range from about 40° to about 60° C. Using this technique, bleach:substrate weight ratios of up to about 15:1 can be obtained. This level of loading is attainable with cellular substrates but substrates of fibrous character are normally limited in practice to weight ratios of not more than about 5:1. Furthermore, loading limitations imposed by the substrate surface area required for the incorporation of the precursor may limit the amount of bleach to less than about 3:1. Provision must also be made for the separation of the bands or areas of bleach and the corresponding bands or areas of precursor during transport and/or storage. This is achieved by interposing layers of material between the layers of substrate or by producing patterns of deposited material that are not coincident on stacking of the substrate. Product decomposition is minimised and product aesthetics such as feel are enhanced during both manufacture and storage if the water content of the composition is minimised. Ideally the composition is substantially anhydrous but more usually the water content is in the range 5–8% by weight of the additive product.

In compositions containing sodium perborate monohydrate in intimate mixture with other components, it has been found that any halide anions present in the mixture react with the bleach when the mixture is heated. Thus chloride salts must be excluded from such mixtures and any cationic surfactants present must be in the form of a non-oxidisable salt such as the methosulphate.

Where the substrate is impregnated, it is believed that the surfaces of the pores or fibres making up the substrate are themselves coated and it is a highly desirable aspect of the substrate that it permits an extensive coating of the peroxy compound precursor to be formed. The term 'coating' connotes the adjoining of one substrate to the surface of another; 'impregnation' is intended to mean the permeation of the entire substrate structure, internally as well as externally. One factor affecting a given substrate's absorbent capacity is its free space. Accordingly, when a precursor is applied to an absorbent substrate, it penetrates into the free space, hence, the substrate is deemed impregnated. The free space in a substrate of low absorbency, such as one-ply kraft or bond paper, is very limited; such a substrate is, therefore, termed "dense". Thus, while a small portion of the precursor penetrates into the limited free space available in a dense substrate, a rather substantial balance of the precursor does not penetrate and remains on the surface of the substrate so that it is deemed a coating.

In one method of making a precursor-impregnated sheet-like substrate, the precursor is applied to absorbent paper or non-woven cloth by a method generally known as padding. The precursor is preferably applied from a liquid to the substrate and precursors which are normally solid at room temperature should first be melted, dissolved in solvent or suspended in a liquid application medium.

In this method, the precursor-containing liquid is placed into a pan or trough which can be heated, if necessary, to maintain the contents in liquid form. Any optional ingredients are then added to the pan or trough. A roll of absorbent substrate is then set up on an apparatus so that it can unroll freely. As the substrate unrolls, it travels downwardly and, submersed, passes through the pan or trough containing the precursor at a slow enough speed to allow sufficient impregnation. The absorbent substrate then travels, at the same speed, upwardly and through a pair or rollers which squeeze off excess bath liquid. The impregnated substrate is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the orifice between their respective surfaces can be regulated to control the amount of the precursor liquid on the substrate.

In another execution of the invention, the precursor in liquid form, is sprayed onto absorbent substrate as it unrolls. The unrolled substrate web is arranged to slide over the spray nozzle which comprises a horizontally disposed tube formed with a slit extending along its top surface. The molten slurry of organic peroxy compound precursor and any additives mixed herewith is forced through the slit into the substrate and the excess liquid is then squeezed off by the use of squeeze rollers. A melt temperature in the range of 40°–80° C., preferably 45°–65° C. is used and the molten material desirably should have a viscosity of less than 5000 centipoises at 50° C., preferably no more than about 500 centipoises.

In a preferred mode of making the products of the invention, the precursor(s) dissolved or dispersed in a molten processing aid are held in a trough formed by the nip of two horizontal rollers arranged side by side and rotating in opposite directions such that the nip is formed by surfaces having approximately the same velocity in a downward direction. Molten material is spread on one of the rolls and transferred to a continuous web of substrate whose speed is the same as that of the roll and which contacts the roll over a limited length of its periphery. The impregnated substrate is then contacted by a smoothing and spreading roll having a direction of rotation such that its contact surface is moving in the opposite direction to that of the substrate. This variation additionally involves the use of metal rollers which can be heated to maintain the precursor in the liquid phase.

A further method involves separately treating a desired number of the individual plies of a multi-ply paper and subsequently adhesively joining the plies with a known adhesive-joiner compound; this provides a composition which can be treated on one of its outer sides, yet contains several other plies, each of which is treated on both sides.

In the preferred method of producing the products of the present invention a mixture of the precursor and any added materials is applied to the substrate as a dispersion in a molten material, usually a processing aid such as polyethyl glycol, but frequently including an ethoxylated nonionic surfactant.

In use, the additive products of the present invention can be introduced into the washing liquor at a point in the washing process where formation of an organic peroxy bleaching species is of most value. In practice optimum results are obtained, irrespective of the washing cycle being employed, when the additive products of the present invention are fed into the machine at the same time as the fabric load. For machines, including a prewash cycle, addition of the additive product at the beginning of the main wash cycle is preferred.

The invention is illustrated in the following non-limitative examples in which parts and percentages are by weight unless otherwise specified.

In the Examples, the abbreviations used have the following designation:

| | |
|---|---|
| LAS | Linear $C_{12}$ alkyl benzene sulphonate |
| TAS | Sodium tallow alcohol sulphate |
| $C_{14/15}$ AS | Sodium $C_{14}$—$C_{15}$ alkyl sulphate |
| $C_{12/14}$ AS | Sodium $C_{12}$—$C_{14}$ alkyl sulphate |
| $TAE_n$ | Tallow alcohol ethoxylated with n moles of ethylene oxide per mole of alcohol |
| $C_{14}$ TMAB | $C_{14}$ alkyl trimethyl ammonium bromide |
| $C_{10}$ TMAMS | $C_{10}$ alkyl trimethyl ammonium methyl sulphate |
| $C_{12}$ TMAB | $C_{12}$ alkyl trimethyl ammonium bromide |
| A 45-E-7 | A $C_{14-15}$ primary alcohol condensed with 7 moles of ethylene oxide. |
| PEG | Polyethylene glycol (MWt normally follows) |
| TAED | Tetraacetyl ethylene diamine |
| PAG | Penta acetyl glucose |
| AOBS | Sodium p-acetoxy benzene sulphonate |
| NOBS | Sodium p-nonanoyl oxybenzene sulphonate |
| OOBS | Sodium p-octanoyl oxybenzene sulphonate |
| LOBS | Sodium p-lauroyl oxybenzene sulphonate |
| Silicate | Sodium silicate having an $SiO_2$:$Na_2O$ ratio of 1.6 |
| STP | Sodium tripolyphosphate |
| CMC | Sodium carboxymethyl cellulose |
| Silicone Compound | 85% polydimethyl siloxane 15% silica |

-continued

| | |
|---|---|
| Silicone Prill | Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide |
| Porphine | Tri/tetrasulphonated zinc phthalocyanine |
| MVEMA | Maleic anhydride/vinyl methyl ether copolymer, believed to have an average molecular weight of 240,000. This material was prehydrolysed with NaOH before addition. |
| Perborate | Sodium perborate tetrahydrate of nominal formula $NaBO_2.3H_2O.H_2O_2$ |
| Perborate monohydrate | Anhydrous sodium perborate bleach of empirical formula $NaBO_2.H_2O_2$ |
| Enzyme | Mixed proteolytic and amylolytic enzyme sold by Novo Industrie AS. |
| EDTA | Sodium ethylene diamine tetra acetate |
| Brightener 1 | Disodium 4,4'-bis(2-morpholino-4-anilino-s-triazin-6-ylamino) stilbene-2:2'-disulphonate. |
| Brightener 2 | Disodium 4,4'-bis(2-sulphonato styryl)biphenyl |
| DETPMP | Diethylene triamine penta(methylene phosphonic acid), marketed by Monsanto under the Trade name Dequest 2060 |
| EDTMP | Ethylenediamine tetra (methylene phosphonic acid), marketed by Monsanto, under the Trade name Dequest 2041 |
| $H_2O_2$ Clathrate | A clathrate of $4Na_2SO_4$: $2H_2O_2$:1NaCl |
| Mixed Suds Suppressor | 25% paraffin wax Mpt 50° C., 17% hydrophobic silica, 58% paraffin oil. |

EXAMPLE 1

Sodium nonanoyl oxybenzene sulphonate was prepared by reacting $C_9$ alkyl fatty acid with trifluoroacetic anhydride and sodium phenol sulphonate for six hours, precipitating the sodium salt from an aqueous alcoholic solution and washing and drying the precipated salt. The sodium nonanoyl oxybenzene sulphonate crystals are passed through a sieve of mesh size 350 microns and redispersed in methanol to form a 25% suspension before being subjected to wet milling using a Fryma Colloid Mill, Model MK95-R/MZ 80R (made by M.M. Process Equipment Ltd, of M.M. House, Frogmore Road, Hemel Hempstead, Hertfordshire, UK) in which the grinding faces are set to provide a separation of 180 microns. The milled suspension is then applied to a hydrophilic, reticulated polyurethane foam sheet substrate. The substrate comprises a 3 mm thick sheet of "Hydrofoam" (RTM) having a density of 0.0036 g/cm$^2$ and a cell count of 25–30 per cm, the sheet size being 36×23 cm and the basis weight being 0.9 g/sheet.

The precursor is applied by immersing the sheet in the suspension to saturate it, excess liquid being subsequently removed by passing the sheet through a nip formed by a pair of rollers. The methyl alcohol vehicle is then evaporated from the sheet to leave a product containing 4.5 g sodium nonanoyl oxybenzene sulphonate.

EXAMPLE 2

Two products (A and B) are prepared using the same substrate and the same processing technique as in Example 1. The composition of Product A comprises 5 g TAED, designed to provide 35 ppm of available oxygen in a 20 liter wash solution assuming theoretical conversion of the precursor, while the composition of Product B comprises 6.3 g NOBS designed to provide 15 ppm available oxygen on the same basis.

The additive products are compared by adding a sheet to a commercial inorganic oxygen bleach-containing detergent and carrying out bleaching performance tests on tea- and wine-stained cotton and polyester-cotton swatches in a washing machine containing a load of clean fabrics as 'ballast'. The sheet is added with the load while the detergent is added via the dispenser. Tests are also carried out using the commercial detergent alone to provide a base line of bleaching performance.

The commercial detergent has the following formula

| | |
|---|---|
| LAS | 5.6 |
| TAS | 2.4 |
| $TAE_{11}$ | 1.0 |
| STP | 24.0 |
| Silicate | 6.0 |
| MVEMA | 1.0 |
| EDTA | 0.2 |
| CMC | 0.8 |
| $MgSO_4$ | 0.4 |
| Enzyme | 0.35 |
| Brightener 1 | 0.23 |
| Brightener 2 | 0.02 |
| Perborate | 32.0 |
| Porphine | 0.005 |
| Mixed Suds Suppressor | 0.4 |
| Sulphate + Misc | 19.095 |
| Water | 6.5 |

For all of the tests an AEG Lavamat Bella automatic washing machine (Model 1OOOE) is used with a supply of softened water (<1.5 grains). 0.5 g EDTMP is added to each wash liquor as a bleach stabiliser before the start of the test. Other conditions for the test are:

1. Wash temperature 30° C., 41b fabric load, 90 g detergent
2. Wash temperature 60° C., 61b fabric load, 135 g detergent.

Results of the tests are shown below and are expressed in terms of Scheffe panel score units on the following scale

| | |
|---|---|
| 0 | No difference |
| 1 | I think this is better |
| 2 | I know this is a little better |
| 3 | I know this is much better |
| 4 | I know this is very much better |

The results are normalised so that the commercial detergent alone has a zero score in each instance.

| Stain/Fabric Type | Temperature | Product A | Product B |
|---|---|---|---|
| Tea/Cotton | 30° C. | 3.13 | 3.19 |
| Tea/Polycotton | 30° C. | 2.53 | 4.25 |
| Wine/Cotton | 30° C. | 2.19 | 3.16 |
| Wine/Polycotton | 30° C. | 2.28 | 3.56 |
| Tea/Cotton | 60° C. | 2.78 | 3.41 |
| Tea/Polycotton | 60° C. | 2.31 | 3.49 |
| Wine/Cotton | 60° C. | 1.97 | 3.49 |

-continued

| Stain/Fabric Type | Temperature | Product A | Product B |
|---|---|---|---|
| Wine/Polycotton | 60° C. | 1.81 | 2.50 |

In each instance it can be seen that Product B, at a level of available oxygen in solution of less than half that of the prior art Product A, provides better bleaching of oxidisable stains.

EXAMPLE 3

Three products incorporating peroxy acid bleach precursors in water releasable combination with a sheet substrate were prepared having the compositions in g/sheet shown below.

| | C | D | E |
|---|---|---|---|
| NOBS | — | 2.1 g | 4.2 g |
| TAED | 5.0 g | 4.3 g | 3.6 g |
| A 45E7 | 5.0 g | 5.0 g | 5.0 g |
| PEG 8000 | 5.0 g | 5.0 g | 5.0 g |
| $C_{14}$ TMAB | 2.0 g | 2.0 g | 2.0 g |
| EDTMP | 0.5 g | 0.5 g | 0.5 g |
| MVEMA | 0.3 g | 0.3 g | 0.3 g |
| Silicone Compound | 0.25 g | 0.25 g | 0.25 g |
| Brightener 2 | 0.1 g | 0.1 g | 0.1 g |
| Perfume | 0.08 g | 0.08 g | 0.08 g |
| Substrate | 2.8 g | 2.8 g | 2.8 g |

Compositions were arranged so that one sheet in a 20 liter wash solution would provide 35 ppm available oxygen from the peracid present assuming theoretical conversion of the precursor(s), Composition C providing 35 ppm from the peracetic acid, Composition D providing 30 ppm from the peracetic acid and 5 ppm from the $C_9$ peroxyacid, and Composition E providing 25 ppm from the peracetic acid and 10 ppm from the $C_9$ peroxyacid. The substrate in each instance was a square patterned apertured non-woven sheet, of size 23×35 cm and basis weight 2.8 g, formed of 100% unbleached crimped rayon fibres (80% fibre, 20% polyacrylate binder).

The products were made in each case by forming a melt of the PEG and A 45E7 at approximately 80° C., dispersing the other components (except the perfume) therein and applying the resultant slurry to the substrate from an applicator roll with which the substrate was brought into contact. Additional rolls were used to spread the slurry before it was cooled to ambient temperature to solidify the composition. Perfume was then sprayed on to the impregnated substrate to produce the final product.

The products were compared by using each to wash a soiled fabric load in the boil (95° C.) cycle of an AEG Lavamat Bella washing machine (Model 1000E) using water of 7 grains hardness (Ca:Mg 2:1 molar) together with 160 g of the commercial laundry detergent used in Example 2. A soiled fabric wash was also carried out under the same conditions with the commercial laundry detergent alone.

In each instance the commercial detergent was added via the product dispenser and the additive products were introduced into the washer drum with the soiled load.

The performance of the products was assessed by means of bleachable stain removal (tea, wine) on cotton and polyester-cotton fabric tracers, and also by means of the cleaning of accumulated soil stains on a woven cotton roller towel sample, the tracers and the sample being included in each load.

Results are shown below expressed in terms of Scheffe panel score units normalised so that the performance of the commercial detergent alone is 0.

| | C | D | E |
|---|---|---|---|
| Tea | | | |
| Cotton | 1.3 | 2.4 | 2.2 |
| Polyester cotton | 0.0 | 0.0 | 0.3 |
| Wine | | | |
| Cotton | 0.6 | 0.7 | 0.5 |
| Polyester cotton | 0.0 | 0.6 | 0.9 |
| Realistic Item Cleaning Cotton Roller Towel | 1.1 | 1.8 | 1.9 |

It can be seen that not only are the products of the invention at least as good as that of the prior art (C) on all of the stain/fabric combinations examined but that, on certain types of classical oxidisable stain (tea on cotton), the products in accordance with the invention (D&E) show a clear benefit over the prior art product (C). More particularly the products of the invention show a clear additional benefit in 'realistic item cleaning' which represents the enhanced removal relative to that provided by the prior art, of ingrained accumulated soil on fabrics.

In similar tests carried out at 30° C., 40° C. and 60° C. similar results to the above were obtained, with particularly large advantages being seen in realistic item cleaning.

EXAMPLE 4

An additive product in sheet form having the composition in g/sheet shown below was prepared using the procedure of Example 3.

| | |
|---|---|
| NOBS | 3.9 |
| $H_2O_2$ Clathrate | 4.5 |
| $C_{12}$ TMAB | 3.0 |
| A 45E7 | 5.0 |
| PEG 8000 | 7.0 |
| EDTMP | 1.0 |
| Enzyme | 1.0 |

-continued

| | |
|---|---|
| Silicone Compound | 0.2 |
| Brightener 2 | 0.1 |
| Perfume | 0.3 |
| Substrate | 2.8 |

The substrate employed was that described in Example 3.

The $H_2O_2$ clathrate was added as a dry powder to the molten mixture of PEG 8000 and Dobanol 45E7, together with the other components. This additive product had a 1:1 molar ratio of NOBS to $H_2O_2$ and was designed such that a single sheet would provide 3 ppm available oxygen under US washing conditions (60 liters wash liquor volume, detergent co-product (US Tide) contains no peroxygen bleach).

EXAMPLE 5

Example 4 was repeated except that 3.6 g of sodium perborate monohydrate was added in place of the $H_2O_2$ clathrate.

This product (G) was performance tested at 40° C. in an AEG Lavamatic Bella machine in water of 7 grains hardness (Ca:Mg=2:1) using in each test a 6 lb soiled fabric load, 100 g of commercial US detergent (US Tide), and 1 sheet of product.

With respect to the performance of the detergent alone, the following results, in Scheffe panel score units, were obtained on realistic item cleaning (cotton Roller Towel).

| Detergent + Product G (no added perborate) | Detergent + Product G + 25%* sodium perborate | Detergent + prior art Product C + 25%* sodium perborate |
|---|---|---|
| 1.4 | 1.8 | 0.2 |

*based on detergent weight

Advantages were also obtained in the removal of a wide range of bleachable, greasy and enzymatic stains from cotton and polyester cotton fabrics.

EXAMPLES 6–14

The following products constitute embodiments of the invention.

| | 6 | 7 | 8 | 9 | 10 | 11 | 12 | 13 | 14 | 15 | 16 |
|---|---|---|---|---|---|---|---|---|---|---|---|
| TAED | | | 3.6 | | | | | | 3.5 | | |
| NOBS | 6.5 | 4.2 | | | 3.9 | 3.9 | | 4.2 | 4.2 | | |
| OOBS | | | | 1.8 | | | 1.8 | | | | |
| DOBS | | | 4.2 | 1.8 | | | 1.8 | | | | |
| PAG | | 3.5 | | | | | | 3.5 | | | |
| Perborate Monohydrate | | | | 3.9 | 3.6 | | | | | | |
| $H_2O_2$ Clathrate | | | | | | 4.5 | | | | | |
| EDTA | | | | 1.0 | 1.0 | | | | | | |
| EDTMP | 0.5 | 0.5 | | | | 0.5 | 0.5 | | 0.5 | | |
| DEDTMP | | | 0.5 | | | | | 0.5 | | | |
| A 45E7 | 5.0 | 5.0 | 5.0 | | | 5.0 | | | 5.0 | | |
| $C_{12}$–$C_{14}$ AS | | | | 3.0 | | | | | | | |
| $C_{14}$–$C_{15}$ AS | | | | | 4.0 | | | | | | |
| $TAE_{25}$ | | | 2.0 | | | | | | | | |
| $C_{10}$ TMAMS | | | | 3.0 | | | | | | | |
| $C_{12}$ TMAB | | | 2.0 | | | | | | | | |
| $C_{14}$ TMAB | 2.0 | 2.0 | | | | 2.0 | | 2.0 | 2.0 | | |
| PEG 8000 | 5.0 | 5.0 | 3.0 | 6.0 | 7.0 | 6.0 | 5.0 | 5.0 | 5.0 | | |
| Silicone Compound | 0.25 | 0.25 | 0.2 | 0.1 | | 0.1 | | | 0.25 | | |
| MVEMA | 0.35 | 0.35 | 0.3 | | | | | 0.3 | 0.35 | | |
| Enzyme | 0.8 | | 0.8 | 0.9 | 0.9 | 0.9 | | 0.6 | 0.6 | | |
| Brightener 1 | | | | 0.1 | 0.1 | | | | | | |
| Brightener 2 | 0.1 | 0.1 | 0.1 | | | 0.1 | | 0.1 | 0.1 | | |
| Perfume | 0.1 | 0.1 | 0.1 | 0.1 | | 0.1 | | 0.1 | 0.1 | | |

-continued

| | 6 | 7 | 8 | 9 | 10 | 11 | 12 | 13 | 14 | 15 | 16 |
|---|---|---|---|---|---|---|---|---|---|---|---|
| Substrate | 2.8 | 2.8 | 2.8 | 2.8 | 2.8 | 2.8 | 0.9 | 2.8 | 2.8 | | |

What I claim is:

1. A detergent additive product consisting essentially of (a) a peroxyacid bleach precursor having the general formula

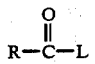

wherein R is an alkyl group containing from about 5 to about 18 carbon atoms wherein the longest portion of the linear alkyl chain extending from and including the carbonyl carbon contains from about 6 to about 10 carbon atoms, and L is a leaving group the conjugate acid of which has a pKa in the range from about 6 to about 13, said peroxy bleach precuror being in water-releasable combination with (b) a non-particulate flexible substrate, the weight ratio of the precursor to the substrate being in the range from about 30:1 to about 1:10;

and wherein said peroxyacid bleach precursor is a particulate having particle size of less than 180 microns.

2. A detergent additive product according to claim 1 wherein R is a $C_5$–$C_{12}$ alkyl group.

3. A detergent additive product according to claim 2 wherein R is a $C_5$–$C_9$ linear alkyl group.

4. A detergent additive product according to claim 2 wherein the conjugate acid of leaving group L has a pKa in the range from about 7 to about 11.

5. A detergent additive product consisting essentially of (a) a peroxyacid bleach precursor having the general formula

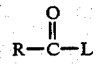

wherein R is an alkyl group containing from about 5 to about 18 carbon atoms wherein the longest portion of the linear alkyl chain extending from and including the carbonyl carbon contains from about 6 to about 10 carbon atoms, wherein the leaving group L is selected from the group consisting of (a)

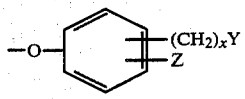

(b)

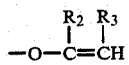

(c)

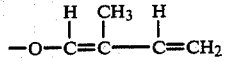

-continued (d)

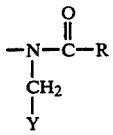

wherein $R_2$ is an alkyl group containing from 1 to 4 carbon atoms; $R_3$ is H or $R_2$; Z is H, $R_2$ or halide; Y is selected from the group consisting of $-SO_3M$ $-OSO_3M$ $-CO_2M$ $-N^+(R_2)_3Q^-$ $-M(R_2)_2\rightarrow O$ wherein M is H, alkali metal or ammonium; and Q is halide or methosulphate: and x is 0 or an integer from 1 to 4.

6. A detergent additive product according to claim 5 wherein L has the formula (a) in which Z is H, x is 0 and Y is $-SO_3M$ or $-CO_2M$.

7. A detergent additive proudct according to claim 6 wherein R is a $C_5$–$C_9$ linear alkyl group.

8. A detergent additive product according to claim 7 wherein the conjugate acid of leaving group L has a pKa in the range from about 7 to about 11.

9. A detergent additive product according to claim 7 wherein R is a $C_7$–$C_8$ alkyl group.

10. A detergent additive product consisting essentially of (a) a composition comprising a combination of (i) a peroxyacid bleach precursor having the general formula

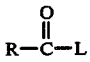

wherein R is an alkyl group containing from about 5 to about 18 carbon atoms wherein the longest portion of the linear alkyl chain extending from and including the carbonyl carbon contains from about 6 to about 10 carbon atoms, and L is a leaving group the conjugate acid of which has a pKa in the range from about 6 to about 13, (ii) a peroxyacetic acid bleach precursor, the ratio of the bleach precursor containing the linear $C_6$–$C_{10}$ carbon chain to the peroxyacetic acid precursor being such as to provide a $C_6$–$C_{10}$ linear carbon chain-containing peroxy acid:peracetic acid molar ratio in the range of from 1:1 to 1:10, said composition being in water releasable combination with (b) a non particulate flexible substrate, the weight ratio of the precursor to the substrate being in the range from about 30:1 to about 1:10.

11. A detergent additive product according to claim 10 wherein the peroxyacetic acid bleach precursor is selected from tetra acetyl ethylene diamine and penta acetyl glucose.

12. A detergent additive product consisting essentially of (a) a composition comprising a combination of (i) a peroxyacid bleach precursor having the general formula

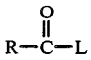

wherein R is an alkyl group containing from about 5 to about 18 carbon atoms wherein the longest portion of the linear alkyl chain extending from and including the carbonyl carbon contains from about 6 to about 10 carbon atoms, and L is a leaving group the conjugate acid of which has a pKa in the range from about 6 to about 13, (ii) a processing aid in the form of a waxy solid having a melting point in the range 30°–70° C. and selected from the group consisting of $C_{12}$–$C_{20}$ fatty acids, $C_{14}$–$C_{18}$ primary and secondary alcohols and ethylene oxide condensates of said fatty acids and alcohols containing from 15 to 80 moles of ethylene oxide per mole of alcohol or acid, polyethylene glycols of MWt 4,000–10,000, sorbitan mono, di and triesters of $C_{12}$–$C_{20}$ fatty acids and mixtures of any of the foregoing, (b) said composition being in water releasable combination with a non particulate flexible substrate, the weight ratio of the precursor to the substrate being in the range from about 30:1 to about 1:10.

13. A detergent additive product according to claim 12 wherein the weight ratio of precursor to processing aid is in range from aout 20:1 to about 1:3.

14. A detergent additive product according to claim 13 wherein the composition is substantially anhydrous.

15. A detergent additive product according to claim 12 also incorporating a source of hydrogen peroxide, the weight ratio of hydrogen peroxide source to substrate being in the range from about 10:1 to from about 1:3.

16. A detergent additive product according to claim 15 wherein the source of hydrogen peroxide is spatially separated from the composition comprising the peroxyacid bleach precursor.

17. A detergent additive product according to claim 16 wherein the source of hydrogen peroxide is selected from the group consisting of sodium perborate tetrahydrate, sodium perborate monohydrate, sodium percarbonate and urea hydrogen peroxide addition compounds.

18. A detergent additive product according to claim 1 wherein said particle size is less than 100 microns.

* * * * *